US006485271B1

(12) United States Patent
Tack

(10) Patent No.: US 6,485,271 B1
(45) Date of Patent: Nov. 26, 2002

(54) BODY SUPPORTING APPARATUS FOR HERMETIC COMPRESSOR

(75) Inventor: Kyung-Sick Tack, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/622,785

(22) PCT Filed: Dec. 29, 1999

(86) PCT No.: PCT/KR99/00834

§ 371 (c)(1),
(2), (4) Date: Aug. 23, 2000

(87) PCT Pub. No.: WO00/40863

PCT Pub. Date: Jul. 13, 2000

(30) Foreign Application Priority Data

Dec. 31, 1998 (KR) ..... 98-28342

(51) Int. Cl.[7] ..... F04B 17/00
(52) U.S. Cl. ..... 417/363; 417/902
(58) Field of Search ..... 417/323, 902

(56) References Cited

U.S. PATENT DOCUMENTS

| | | | | |
|---|---|---|---|---|
| 3,578,279 A | * | 5/1971 | Owen | 248/20 |
| 4,427,349 A | * | 1/1984 | Elson | 417/363 |
| 4,549,859 A | * | 10/1985 | Andrione et al. | 417/363 |
| 5,934,884 A | * | 8/1999 | Son | 417/363 |
| 6,004,113 A | * | 12/1999 | Vay | 417/363 |

FOREIGN PATENT DOCUMENTS

| | | |
|---|---|---|
| JP | 52-106814 | 8/1977 |
| JP | 63-26785 | 2/1988 |
| KR | 89-13528 | 8/1989 |
| KR | 92-900 | 1/1992 |

* cited by examiner

*Primary Examiner*—Charles G. Freay
*Assistant Examiner*—William Rodriguez
(74) *Attorney, Agent, or Firm*—Fleshner & Kim, LLP

(57) ABSTRACT

A body supporting apparatus is provided for motored compressors. The body supporting apparatus includes two coil springs that connect a seat spring of a stator to a seat spring of a lower casing holding the stator thereon, The two coil springs thus stably support the stator on the lower casing. A cylindrical spring guider is set between the two coil springs with an annular support ring formed around the central portion of the internal surface of the guide and supporting the two coil springs on opposite surfaces thereof within the guider. Two coil seat chambers are formed in the cylindrical guider at positions above and under the support ring and communicate with each other through a central opening of the support ring. The two coil springs are movably received within the two coil seas chambers such that the elastic compressive and tensile movement of the two coil springs are axially and stably guided within the associated chambers of the guider without being undesirably moved in a transverse direction. The body supporting apparatus for motored compressors almost completely prevents the stator support coil springs from undesirable movement in a transverse direction, thus preventing a transverse vibration of the stator during an operation of such a motored compressor.

22 Claims, 3 Drawing Sheets

BODY SUPPORTING APPARATUS FOR HERMETIC COMPRESSOR

TECHNICAL FIELD

The present invention relates, in general, to motored compressors and, more particularly, to a body supporting apparatus for such motored compressors designed to support a frame in a compressor while minimizing operational vibration of the frame, thus improving the operational reliability of such compressors.

BACKGROUND ART

FIG. 1 shows the internal construction of a conventional motored compressor. As shown in the drawing, the conventional motored compressor comprises a hermetic housing 1 consisting of upper and lower casings 1*t* and 1*b*, with a plurality of desired parts constituting the motored compressor being set within the interior of the housing 1. For example, a frame 2 is set within the interior of the housing 1. A stator 3 is fixedly mounted to the frame 2 while being held at a desired position by a spring 3S.

FIG. 2 shows a structure for holding the stator 3 on the frame by the spring 3S in detail. As shown in the drawing, the upper end of the spring 3S is inserted into a seat spring 3' provided on the lower surface of the stator 3, while the lower end of the spring 3S is inserted into a seat spring 1*b*' of the lower casing 1*b*. In the above structure, the seat spring 1*b*' of the lower casing 1*b* also acts as a stopper used for limiting the downward vibration of the stator 3. That is, the lower end of the seat spring 3' comes into contact with the upper end of the other seat spring 1*b*', thus allowing the seat spring 1*b*' to collaterally act as a stopper for limiting the downward vibration of the stator 3.

On the other hand, a crankshaft 5 is installed within the hermetic housing 1 while passing through the central portion of the frame 2, while a rotor 4 is integrated with the crankshaft 5 into a single structure. The above rotor 4 is electromagnetically rotated along with the crankshaft 5 in cooperation with the stator 3.

An eccentric pin 5*b* is provided on the upper end of the crankshaft 5 while being eccentric from the rotating axis of the crankshaft 5. A balance weight 5*c* is provided on the crankshaft 5 at a position opposite to the eccentric pin 5*b*. The above crankshaft 5 is rotatably held on the frame 2.

An oil passage 5*a* is formed in the crankshaft 5 and guides lubrication oil L from the bottom of the hermetic housing 1 to the upper portion of the frame 5 prior to spraying the oil at the upper portion of the frame 5. In addition, a pump 5*d* is provided on the lower end of the crankshaft 5 and generates pumping force for sucking the lubrication oil L from the bottom of the housing 1 to the oil passage 5*a* of the crankshaft 5.

On the other hand, a cylinder 6, having a compression chamber 6', is integrated with the frame 2 into a single structure, with a piston 7 being set in the compression chamber 6' of the cylinder 6. The above piston 7 is connected to the eccentric pin 5*b* of the crankshaft 5 through a connecting rod 8. A valve assembly 9 is installed on the end of the cylinder 6. This valve assembly 9 controls a flowing of refrigerant which is sucked into and exhausted from the compression chamber 6' of the cylinder 6. A head cover 10 is mounted to the valve assembly 9. In the head cover 10, a suction muffler 11 is connected to the valve assembly 9 and introduces the refrigerant into the compression chamber 6' through the valve assembly 9.

In the drawings, the reference numeral 12 denotes a suction pipe used for leading the refrigerant into the interior of the hermetic housing 1, and the reference numeral 13 denotes an exhaust pipe used for discharging the compressed working fluid from the compressor into the outside of the compressor.

The above-mentioned motored compressor is operated as follows. When the compressor is electrically activated, the rotor 4 is electromagnetically rotated in cooperation with the stator 3. The crankshaft 5, integrated with the rotor 4, is thus rotated along with the rotor 4. When the crankshaft 5 is rotated as described above, the eccentric pin 5*b* is rotated along with of the crankshaft 5 while forming a circular trace around the shaft 5. In addition, the connecting rod 8, connected to the eccentric pin 5*b*, is driven by the pin 5*b*, thus allowing the piston 7 to perform a linear reciprocating action within the compression chamber 6' of the cylinder 6. Due to such a linear reciprocating action of the piston 7 within the compression chamber 6', the refrigerant is compressed.

During such an operation of the compressor, the stator 3 is may be undesirably vibrated due to several causes, for example, a rotating action of both the rotor 4 and the crankshaft 5 and a linear reciprocating action of the piston 7. The conventional motored compressor is thus designed to reduce such a vibration of the stator 3 using the spring 3S, which holds the stator 3 on the lower casing 1*b*.

However, the conventional support structure, designed to simply support the stator 3 on the lower casing 1*b* using the spring 3S, is problematic in that it fails to effectively reduce the vibration of the stator 3. In an effort to overcome such a problem, another support structure of FIG. 3 is proposed.

In the support structure of FIG. 3, a stator 3 is held on the lower casing 1*b* using two springs 3S1 and 3S2, with a connection member M being used for connecting the two springs 3S1 and 3S2. When the two springs 3S1 and 3S2 are connected to each other using the connection member M, it is possible to remarkably improve the elastic vertical support characteristics V of the springs 3S1 and 3S2 holding the stator 3 on the lower casing 1*b*. However, this support structure has a problem in elastic lateral support characteristics C of the springs 3S1 and 3S2. Therefore, the lateral movement of the stator 3 is gradually increased during an operation of the motored compressor, and so the frame 2 and/or the stator 3 are undesirably brought into partial contact with the interior surface of the hermetic housing 1.

In addition, the connection member M undesirably forms two gaps G1 and G2 between the connection member M and the two seat springs 3' and 1*b*' of both the stator 3 and the lower casing 1*b*, with the two gaps G1 and G2 requiring a special precise management. That is, the presence of the connection member M between the two seat springs 3' and 1*b*' in the support structure undesirably forces a user to more precisely manage the two gaps G1 and G2 and to allow the connection member M along with the two seat springs 3' and 1*b*' to act as a stopper.

DISCLOSURE OF THE INVENTION

Accordingly, the present invention has been made keeping in mind the above problems occurring in the prior art, and an object of the present invention is to provide a body supporting apparatus for motored compressors, which is designed to support a frame in a hermetic housing while desirably reducing operational vibration of the frame.

In order to accomplish the above object, the present invention provides a body supporting apparatus for motored compressors, comprising a stator installed on the frame of a motored compressor, the frame having a vibration source, an elastic member connected to the stator so as to support the stator, a fixed support part fixedly installed relative to the stator and used for supporting the elastic member, and a guider installed at the middle portion of the elastic member and used for guiding an elastic movement of the elastic member.

In the above body supporting apparatus, the guider receives the middle portion of the elastic member therein, thus intercepting an undesirable elastic lateral movement of the elastic member.

The body supporting apparatus for motored compressors of this invention is designed to intercept an undesirable lateral movement of a plurality of coil springs using a cylindrical guider, with the coil springs being used for absorbing vibration generated during an operation of a compressor. This body supporting apparatus thus finally reduces vibration of the frame within such a motored compressor.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
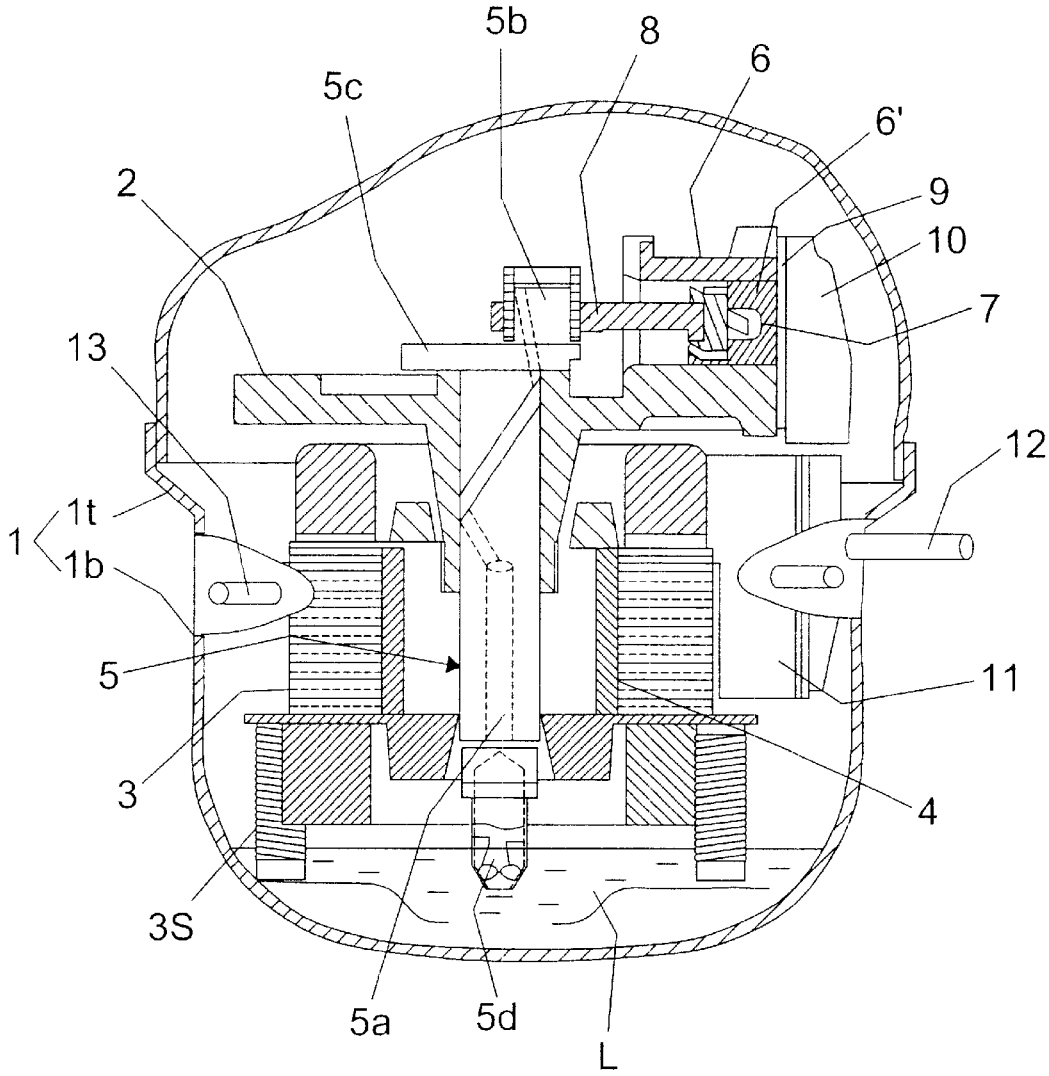
FIG. 1 PRIOR ART
FIG. 1 is a sectional view, showing the internal construction of a conventional motored compressor.
Figure 2:
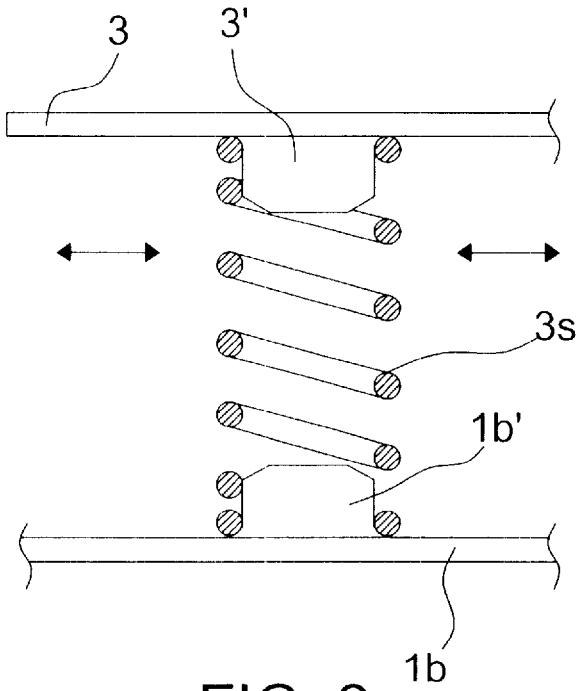
FIG. 2 PRIOR ART
FIG. 2 is a sectional view, showing a conventional frame support structure for such motored compressors.
Figure 3:
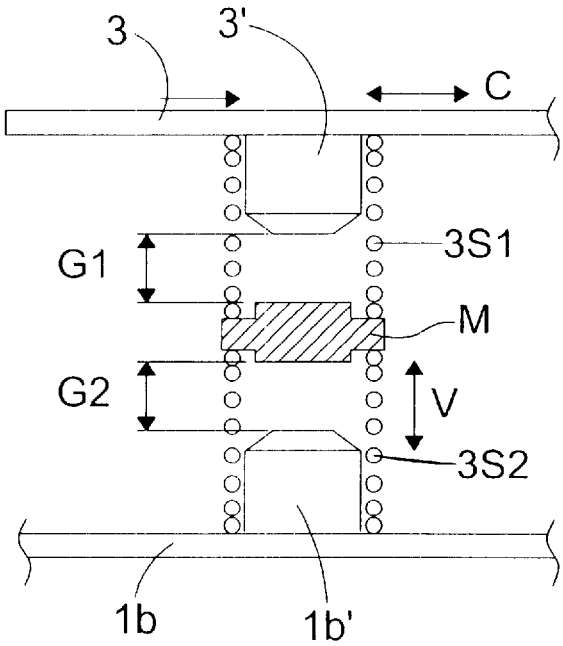
FIG. 3 PRIOR ART
FIG. 3 is a sectional view, showing a conventional frame support structure in accordance with another embodiment of the prior art.

Reference now should be made to the drawings, in which the same reference numerals are used throughout the different drawings to designate the same or similar components.

Figure 4:
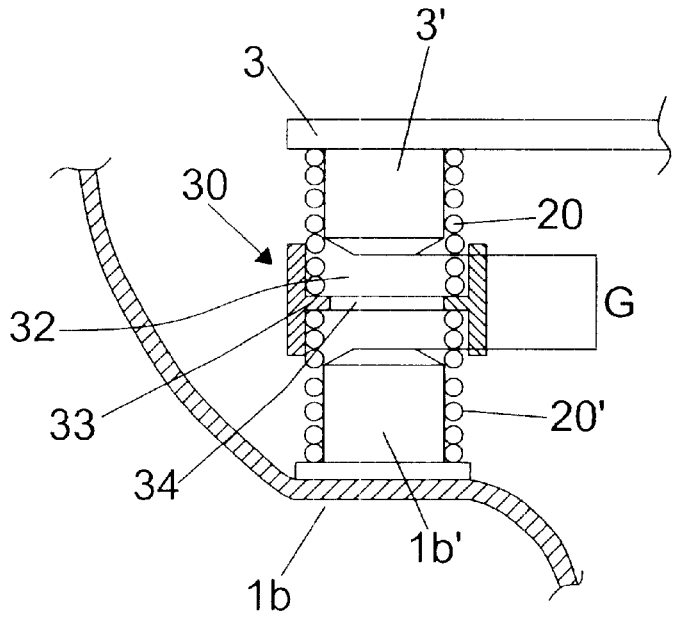
FIG. 4 is a sectional view, showing the construction of a body supporting apparatus for motored compressors in accordance with the preferred embodiment of the present invention.
Figure 5:
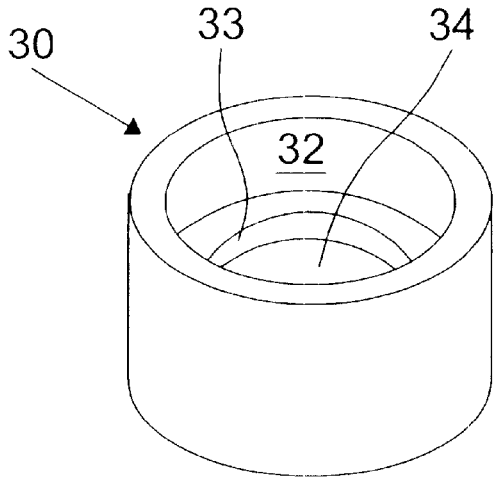
FIG. 5 is a perspective view of a guider included in the body supporting apparatus of FIG. 4.

FIGS. 4 and 5 show the construction of a body supporting apparatus for motored compressors in accordance with the preferred embodiment of the present invention. As shown in the drawings, the body supporting apparatus of this invention comprises a plurality of coil springs 20 and 20' used for supporting the lower surface of a stator 3. In the present invention, it is preferable to support the stator 3 using the springs 20 and 20' at four positions. However, it should be understood that the number of the support positions of the springs 20 and 20' is not limited to the four positions. Of the coil springs 20 and 20', each of the upper springs 20 holds the lower portion of the stator 3, with the upper ends of the upper springs 20 being received into the seat springs 3' of the stator 3. On the other hand, the lower end of each upper spring 20 is received into an upper seat chamber 32 of a cylindrical guider 30 and is seated on the upper surface of an annular support ring 33 formed in the middle portion of the guider 30. The construction of the guider will be described in more detail later herein.

The upper end of each lower spring 20' is received into a lower seat chamber 32 of the cylindrical guider 30 and is seated on the lower surface of the annular support ring 33. On the other hand, the lower end of each lower spring 20' is supported by the seat spring 1*b*' as will be described herein below.

The seat spring 1*b*', used for supporting the lower end of the lower spring 20', is provided on the lower casing 1*b*. The lower end of the lower spring 20' is inserted into and supported by the seat spring 1*b'*.

As best seen in FIG. 5, a cylindrical spring guider 30 is set between two springs 20 and 20', with two coil seat chambers 32 being formed in the cylindrical guider 30 at positions above and under the support ring 33 and receiving the opposing ends of the two springs 20 and 20'. In the present invention, it is preferable to allow the inner diameter of each seat chamber 32 to be equal to or slightly larger than the outer diameter of each spring 20, 20'. However, it should be understood that it is possible to form the inner diameter of the seat chambers 32 of the guider 30 in a way such that the chambers 32 reliably guide a movement of the springs 20 and 20' without allowing an undesirable lateral displacement of the springs 20 and 20'. On the other hand, it is preferable to make the guider 30 using an insulation material, such as a plastic material.

Within the guider 30, the two seat chambers 32 are divided from each other by the annular support ring 33 formed around the central portion of the internal surface of the guider 30. The above annular support ring 33 supports the two coil springs 20 and 20' on its opposite surfaces. The support ring 33 has a central opening 34, and so the ring 33 does not completely isolate the two seat chambers 32 from each other, but allows the two chambers 32 to communicate with each other through the central opening 34. In such a case, the inner diameter of the central opening 34 of the ring 33 is larger than the outer diameter of the opposing ends of the seat springs 3' and 1*b*', thus allowing the seat springs 3' and 1*b*' to selectively come into contact with each other and to act as stoppers during an operation of the compressor.

The body supporting apparatus of this invention is operated as follows. That is, when a compressor is operated, the rotor 4 is electromagnetically rotated along with the crankshaft 5 in cooperation with the stator. Due to the rotating action of the crankshaft 5, the piston 7 performs a linear reciprocating action within the compression chamber 6', thus compressing the refrigerant.

During such an operation of the compressor, the stator 3, on which both the rotor 4 and the crankshaft 5 are rotated supported, is vibrated. In addition, the refrigerant suction, compression and exhaust operation of the piston 7 of the compression chamber 6' allows both the frame 2 and the stator 3 to be vibrated.

In the body supporting apparatus of this invention, such vibration of both the frame 2 and the stator 3 is effectively reduced by the springs 20 and 20', which hold the stator 3 within the lower casing 1*b* of the hermetic housing 1. That is, the vertical component of the vibration of the stator 3 is effectively absorbed by an axial elastic movement of the springs 20 and 20'.

On the other hand, the horizontal component of the vibration of the stator 3 is effectively intercepted by the cylindrical guider 30. As well known to those skilled in the art, such coil springs 20 and 20' do not effectively resist such lateral vibration. However, the cylindrical guider 30 included in the support apparatus of this invention smoothly guides the external surfaces of the springs 20 and 20' while effectively intercepting a lateral vibration of the springs 20 and 20'.

On the other hand, the seat springs 3' and 1*b*' are designed to face each other through the central opening 34 of the cylindrical guider 30, and so the body supporting apparatus of this invention forms only one gap G between the two seat springs 3' and 1*b*', with the gap G requiring a special precise management so as to allow the two seat springs 3' and 1*b*' to act as stoppers. It is thus easy to design and assemble the body supporting apparatus of this invention in comparison with a conventional frame support structure having two gaps. That is, the cylindrical spring guider 30 has two seat chambers 32, with the support ring 33 being formed in the cylindrical guider 30. The support ring 33 divides the two chambers 32 from each other and supports the opposing ends of the two springs 20 and 20', with the central opening 34 being defined in the support ring 33 and allowing the two seat chambers 32 to communicate with each other through the central opening 34. In the support device of this invention, the guider 30 is free from coming into contact with the seat springs 3' and 1*b*' due to an axial elastic movement of the coil springs 20 and 20'. However, such an axial elastic movement of the coil springs 20 and 20' only allows the seat springs 3' and 1*b*' to come into selective contact with each other and to act as stoppers. Therefore, the body supporting apparatus of this invention forms only one gap G, requiring a special precise management so as to allow the seat springs 3' and 1*b*' to act as stoppers, between the two seat springs 3' and 1*b*'.

The cylindrical guider 30 also normally and electrically insulates the seat at 10 springs 3' and 1*b*' from each other. Therefore, the guider 30 effectively intercepts current, leaking from at least one of the stator 3 and the rotor 4, without allowing the leaking current to be undesirably applied to the lower casing 1*b*.

INDUSTRIAL APPLICABILITY

As described above, the present invention provides a body supporting apparatus for motored compressors, which is designed to support a frame in a hermetic housing while desirably reducing operational vibration of the stator using a plurality of coil springs during an operation of the compressor. In the support apparatus of this invention, a cylindrical guider stably supports the opposing ends of the coil springs, thus allowing the coil springs to be almost completely free from an undesirable lateral movement. This finally reduces an undesirable lateral movement of the stator and prevents the stator from being brought into undesirable contact with the internal surface of the hermetic housing of the compressor, thus improving the operational reliability of such motored compressors.

On the other hand, the body supporting apparatus of this invention is also designed to reduce the number of the gaps between the stator and the lower casing, with the gap requiring a special precise management. It is thus easy to design and assemble the body supporting apparatus of this invention in comparison with a conventional frame support structure having two or more gaps. This finally reduces the production such motored compressors. In addition, the cylindrical guider also normally and electrically insulates the stator and the lower casing from each other, and so the body supporting apparatus of this invention effectively intercepts leaking current without allowing the leaking current to be undesirably applied to the lower casing.

What is claimed is:

1. A body supporting apparatus for motored compressors, comprising:

a stator installed on a frame of a motored compressor, said frame having a vibration source;

an elastic member connected to said stator and configured to support the stator;

a fixed support part fixedly installed relative to the stator and configured to support the elastic member; and a guider installed at a middle portion of the elastic member and configured to guide an elastic movement of the elastic member, the guider having a central opening extending therethrough for receiving the elastic member.

2. The body supporting apparatus according to claim 1, wherein the guider is in the shape of a cylinder.

3. The body supporting apparatus according to claim 2, wherein the elastic member comprises a pair of elastic members, and the guider is positioned between the pair of elastic members.

4. The body supporting apparatus according to claim 3, wherein the guider includes an annular support ring disposed in the opening which divides the opening into an upper chamber and a lower chamber, and wherein the upper chamber receives a lower portion of one of the pair of elastic members and the lower chamber receives an upper portion of the other of the pair of elastic members.

5. The body supporting apparatus as claimed in claim 1, wherein the elastic member comprises a pair of elastic members, and the guider is positioned between the pair of elastic members.

6. The body supporting apparatus as claimed in claim 5, wherein the guider includes an annular support ring disposed in the opening which divides the opening into an upper chamber and a lower chamber, wherein the upper chamber receives a lower portion of one of the pair of elastic members and the lower chamber receives an upper portion of the other of the pair of elastic members.

7. A body supporting apparatus for a motored compressor, comprising:

a stator installed on a frame of a motored compressor, the frame having a vibration source;

a support part positioned adjacent to the stator;

an elastic member configured to support the stator, the elastic member being positioned between the stator and the support part; and a guider configured to control an elastic movement of the elastic member, the guider having an opening extending therethrough for receiving the elastic member.

8. The body supporting apparatus according to claim 7, wherein the guider is in the shape of a cylinder.

9. The body supporting apparatus according to claim 8, wherein the elastic member comprises a pair of elastic members, and the guider is positioned between the pair of elastic members.

10. The body supporting apparatus according to claim 9, wherein the guider includes an annular support ring disposed in the opening which divides the opening into an upper chamber and a lower chamber, and wherein the upper chamber receives a lower portion of one of the pair of elastic members and the lower chamber receives an upper portion of the other of the pair of elastic members.

11. The body supporting apparatus as claimed in claim 7, wherein the elastic member comprises a pair of elastic members, and the guider is positioned between the pair of elastic members.

12. The body supporting apparatus as claimed in claim 11, wherein the guider includes an annular support ring disposed in the opening which divides the opening into an upper chamber and a lower chamber, and wherein the upper chamber receives a lower portion of one of the pair of elastic members and the lower chamber receives an upper portion of the other of the pair of elastic members.

13. The body supporting apparatus as claimed in claim 7, wherein the guider is provided at a middle portion of the elastic member.

14. The body supporting apparatus as claimed in claim 7, wherein the opening is centrally located with respect to a central longitudinal axis of the guider.

15. A compressor having a stator installed on a frame of the motored compressor, the frame having a vibration source, and a support part positioned adjacent to the stator, wherein the improvement comprises a body supporting apparatus having;

an elastic member configured to support the stator, the elastic spring being positioned between the stator and the support part; and a guider configured to control an elastic movement of the elastic member, the guider having an opening extending therethrough for receiving the elastic member.

16. The body supporting apparatus according to claim 15, wherein the guider is in the shape of a cylinder.

17. The body supporting apparatus according to claim 16, wherein the elastic member comprises a pair of elastic members, and the guider is positioned between the pair of elastic members.

18. The body supporting apparatus according to claim 17, wherein the guider includes an annular support ring disposed in the opening which divides the opening into an upper chamber and a lower chamber, and wherein the upper chamber receives a lower portion of one of the pair of elastic members and the lower chamber receives an upper portion of the other of the pair of elastic members.

19. The body supporting apparatus as claimed in claim 15, wherein the elastic member comprises a pair of elastic members, and the guider is positioned between the pair of elastic members.

20. The body supporting apparatus as claimed in claim 19, wherein the guider includes an annular support ring disposed in the opening which divides the opening into an upper chamber and a lower chamber, and wherein the upper chamber receives a lower portion of one of the pair of elastic members and the lower chamber receives an upper portion of the other of the pair of elastic members.

21. The body supporting apparatus as claimed in claim 15, wherein the guider is provided at a middle portion of the elastic member.

22. The body supporting apparatus as claimed in claim 15, wherein the opening is centrally located with respect to a central longitudinal axis of the guider.

* * * * *